US009224510B2

(12) United States Patent
Wegeler et al.

(10) Patent No.: US 9,224,510 B2
(45) Date of Patent: Dec. 29, 2015

(54) HANDLING SYSTEM FOR A CONTAINER FOR NUCLEAR FUEL ASSEMBLY

(75) Inventors: Pierre Wegeler, Villieu (FR); Jacques Gauthier, Cailloux sur Fontaines (FR)

(73) Assignee: AREVA NP, Courbevoie (FR)

( * ) Notice: Subject to any disclaimer, the term of this patent is extended or adjusted under 35 U.S.C. 154(b) by 703 days.

(21) Appl. No.: 13/121,582

(22) PCT Filed: Sep. 30, 2009

(86) PCT No.: PCT/FR2009/051858

§ 371 (c)(1),
(2), (4) Date: Mar. 29, 2011

(87) PCT Pub. No.: WO2010/037971

PCT Pub. Date: Apr. 8, 2010

(65) Prior Publication Data

US 2011/0187139 A1 Aug. 4, 2011

(30) Foreign Application Priority Data

Sep. 30, 2008 (FR) ..... 08 56618

(51) Int. Cl.
*G21F 5/14* (2006.01)
*B66C 1/66* (2006.01)
(Continued)

(52) U.S. Cl.
CPC ... *G21F 5/14* (2013.01); *B66C 1/10* (2013.01); *B66C 1/62* (2013.01); *B66C 1/663* (2013.01);
(Continued)

(58) Field of Classification Search
CPC ..... B25J 15/0028; B66C 1/107; B66C 1/66; B66C 1/666; B66C 1/427; B66C 1/54; B66C 1/10; B66C 3/08; B66C 1/663; B66C 1/485; B66C 1/62; B66C 1/223; G21F 5/14; B60P 7/13; B60P 7/132; B65G 65/24; B65G 47/90; B65G 47/902; B65G 47/904; B65G 7/12; B65G 65/23; B65G 47/252; B23Q 7/165; B23Q 7/055; B23Q 7/04; E04G 21/142; B65H 67/065; B65H 15/02; B65H 15/00; E21B 31/18; E21B 19/155; G21C 19/32; G21C 21/02; G21C 19/00; G21C 19/065; B23K 9/1336; B66F 9/18; B66F 9/19; B66F 9/186; B66F 9/184; B66F 9/125; B66F 9/08; B66F 9/06; B66F 9/145; B66F 9/149; B66B 17/26; B66B 17/14; B02C 17/205; B21D 43/105; B21B 39/32; B21B 39/30
USPC ..... 294/89, 86.4, 86.41, 86.11, 67.31, 294/81.51, 28, 82.31; 414/22.55, 146, 431, 414/432, 608, 620, 626, 632, 637, 638, 650, 414/746.3, 634, 665, 758, 759, 764, 766; 376/272; 206/524.1
See application file for complete search history.

(56) References Cited

U.S. PATENT DOCUMENTS 1,029,139 A * 6/1912 Moltrup ..... 294/81.56
1,614,400 A * 1/1927 Selman et al. ..... 294/68.26
(Continued)

FOREIGN PATENT DOCUMENTS

DE 2364928 7/1975
DE 29812414 11/1998
(Continued)

*Primary Examiner* — Glenn Myers
(74) *Attorney, Agent, or Firm* — Davidson, Davidson & Kappel, LLC

(57) ABSTRACT

A handling system including a tool for lifting the container, wherein the lifting tool includes a lifting carrier to be suspended and a member for gripping the container comprising removable devices for fastening the container onto the gripping member.
According to one aspect of the invention, the gripping member is mounted so that it may rotate on the lifting carrier about a substantially horizontal rotation axis when the lifting carrier is suspended.

17 Claims, 9 Drawing Sheets

(51) Int. Cl.
*B66C 1/10* (2006.01)
*B66C 1/62* (2006.01)

(52) U.S. Cl.
CPC ..... *G21Y 2002/203* (2013.01); *G21Y 2002/304* (2013.01); *G21Y 2002/305* (2013.01); *G21Y 2004/30* (2013.01); *G21Y 2004/501* (2013.01)

(56) References Cited

U.S. PATENT DOCUMENTS

| | | | | | |
|---|---|---|---|---|---|
| 2,384,307 | A | * | 9/1945 | Husson et al. | 294/67.31 |
| 2,390,293 | A | * | 12/1945 | Colson | 294/86.41 |
| 3,048,280 | A | * | 8/1962 | Huff et al. | 29/726.5 |
| 3,103,282 | A | * | 9/1963 | York | 212/332 |
| 3,191,788 | A | * | 6/1965 | Hopfeld | 414/420 |
| 3,239,077 | A | * | 3/1966 | Huff et al. | 29/726.5 |
| 3,249,063 | A | * | 5/1966 | Barry | 104/93 |
| 3,253,851 | A | * | 5/1966 | Gilbert | 294/119.2 |
| 3,304,115 | A | * | 2/1967 | Brooks et al. | 294/81.5 |
| 3,432,041 | A | * | 3/1969 | Van Huet | 414/626 |
| 3,583,586 | A | * | 6/1971 | Burton | 414/620 |
| 3,587,892 | A | * | 6/1971 | Vermette | 414/420 |
| 3,606,952 | A | * | 9/1971 | Mankey | 414/608 |
| 3,670,912 | A | * | 6/1972 | Dunbar | 414/420 |
| 3,915,311 | A | * | 10/1975 | Ball et al. | 414/766 |
| 3,995,903 | A | * | 12/1976 | Ernst | 294/81.3 |
| 4,023,818 | A | * | 5/1977 | Troller | 280/79.11 |
| 4,051,966 | A | * | 10/1977 | Cotton | 414/428 |
| 4,184,801 | A | * | 1/1980 | Nicoloff et al. | 414/608 |
| 4,286,722 | A | | 9/1981 | Tax et al. | |
| 4,306,699 | A | * | 12/1981 | Neufeldt | 248/134 |
| 4,373,755 | A | | 2/1983 | Herberholz et al. | |
| 4,451,198 | A | | 5/1984 | Sanderson | |
| 4,496,275 | A | * | 1/1985 | Harp | 414/420 |
| 4,557,515 | A | | 12/1985 | Read | |
| 4,951,990 | A | * | 8/1990 | Hollan et al. | 294/119.1 |
| 5,032,054 | A | * | 7/1991 | Krajicek et al. | 414/745.3 |
| 5,043,132 | A | * | 8/1991 | Schramm et al. | 376/260 |
| 5,152,958 | A | * | 10/1992 | Ellingson et al. | 376/272 |
| 5,161,709 | A | * | 11/1992 | Oestreich, Jr. | 220/6 |
| 5,163,804 | A | * | 11/1992 | Kobayashi | 414/739 |
| 5,221,118 | A | * | 6/1993 | Koltookian | 294/86.41 |
| 5,393,190 | A | * | 2/1995 | Vickary | 414/420 |
| 5,429,490 | A | * | 7/1995 | Myers et al. | 425/436 R |
| 5,888,043 | A | * | 3/1999 | Jatcko | 414/459 |
| 6,921,240 | B2 | * | 7/2005 | Moore | 414/607 |
| 8,061,951 | B2 | * | 11/2011 | Marston et al. | 414/421 |
| 8,226,140 | B1 | * | 7/2012 | Dietrich et al. | 294/119.1 |
| 2007/0110549 | A1 | * | 5/2007 | Waisanen | 414/458 |
| 2009/0232634 | A1 | * | 9/2009 | Waisanen | 414/816 |

FOREIGN PATENT DOCUMENTS

| | | |
|---|---|---|
| EP | 0 263 336 B1 | 8/1992 |
| EP | 0919509 | 6/1999 |
| JP | 57022598 | 2/1982 |
| JP | 02-80999 | 3/1990 |
| JP | 03100275 | 10/1991 |
| JP | 6286971 | 10/1994 |

* cited by examiner

HANDLING SYSTEM FOR A CONTAINER FOR NUCLEAR FUEL ASSEMBLY

The invention relates to a handling system for a container for nuclear fuel assembly, of the type comprising a tool for lifting the container, wherein the lifting tool comprises a lifting carrier to be suspended and a member for gripping the container comprising removable devices for fastening the container onto the gripping member.

BACKGROUND

Nuclear fuel assemblies undergo numerous handling operations during their life.

Indeed, new (or non irradiated) nuclear fuel assemblies are generally manufactured on a production site, then transported to a nuclear power station where they are initially stored then inserted into the core of a nuclear reactor. After several irradiation cycles, the used (or irradiated) assemblies are removed from the core, may possibly be stored temporarily at the nuclear power station, then are sent to the retreatment plant or to a final storage location.

The fuel assemblies are generally transported in specific containers adapted to the assemblies, whether new or used, to be transported. Each container loaded with one or more fuel assemblies is generally positioned horizontally on the vehicle, in particular a road transport vehicle and the container is transported to a first site (for example a inter-regional store or a nuclear power station), using if necessary intermodal means (road, rail, maritime and/or air transport).

During the phases of loading and unloading the transport vehicle or the loading and unloading of the fuel assembly in the container itself, the container is generally handled in the horizontal position. The assembly transported may be loaded and unloaded with the container in the vertical position. This requires the container to be tilted to the vertical position for the loading and unloading then returned to the horizontal position for the transport.

The containers for nuclear fuel assemblies, whether empty or full, are generally heavy and cumbersome, which makes the handling operations more complicated.

SUMMARY OF THE INVENTION

An object of the invention is to provide a handling system for containers for nuclear fuel assemblies which facilitates the handling of containers for nuclear fuel assemblies.

For this purpose, the invention provides a handling system for containers for nuclear fuel assemblies of the type mentioned above, characterised in that the gripping member is mounted so that it may rotate on the lifting carrier about a substantially horizontal rotation axis when the lifting carrier is suspended.

According to other embodiments, the handling system comprises one or several of the following features, considered separately or in any of the combinations that are technically possible:

the gripping member is movable with respect to the lifting carrier in a vertical lifting position which allows a container gripped by the lifting carrier to be held substantially in the vertical position when the lifting carrier is suspended;

the gripping member is movable with respect to the lifting carrier in at least one horizontal lifting position which allows a container gripped by the lifting carrier to be held substantially in the horizontal position when the lifting carrier is suspended;

the gripping member is movable with respect to the lifting carrier in two horizontal lifting positions, which allows a container to be held at two different heights with respect to the lifting carrier;

the gripping member is movable with respect to the lifting carrier in a horizontal lifting position, in which the axis of rotation extends through the container, preferably close to the centre of gravity of the container;

the gripping member is movable with respect to the lifting carrier in a horizontal lifting position, in which the axis of rotation extends above the container;

in the horizontal lifting position, the container is positioned below the level of lower ends of 1 bars of a stirrup-shaped lifting carrier;

wherein the gripping member pivots 180° around the axis of rotation between the first horizontal lifting position and the between the second horizontal lifting position;

the lifting carrier is stirrup shaped and comprises two bars that are substantially vertical when the lifting carrier is suspended, that can hold the container between them;

the gripping member is joined to each bar by two arms positioned in a V shaped layout which are joined at an articulation on the bar, and which separate in the direction of the gripping member;

the assembly comprises a transport chassis for several containers placed side by side;

the chassis comprises a cradle and transversal bars to support the containers joined to the cradle by suspensions;

the gripping member and the chassis are adapted to allow the chassis to be lifted using the gripping member;

the chassis comprises lateral barriers with setbacks to allow the forks of a fork lift truck to pass so that a container may be loaded or unloaded from the chassis;

the chassis comprises chassis members joined by connectors which allow the chassis loaded with at least one container to be handled.

BRIEF DESCRIPTION OF THE DRAWINGS

The invention and its advantages will be more clearly understood upon reading the following description, provided solely by way of reference and in reference to the appended drawings, in which.

DETAILED DESCRIPTION

Figure 1:
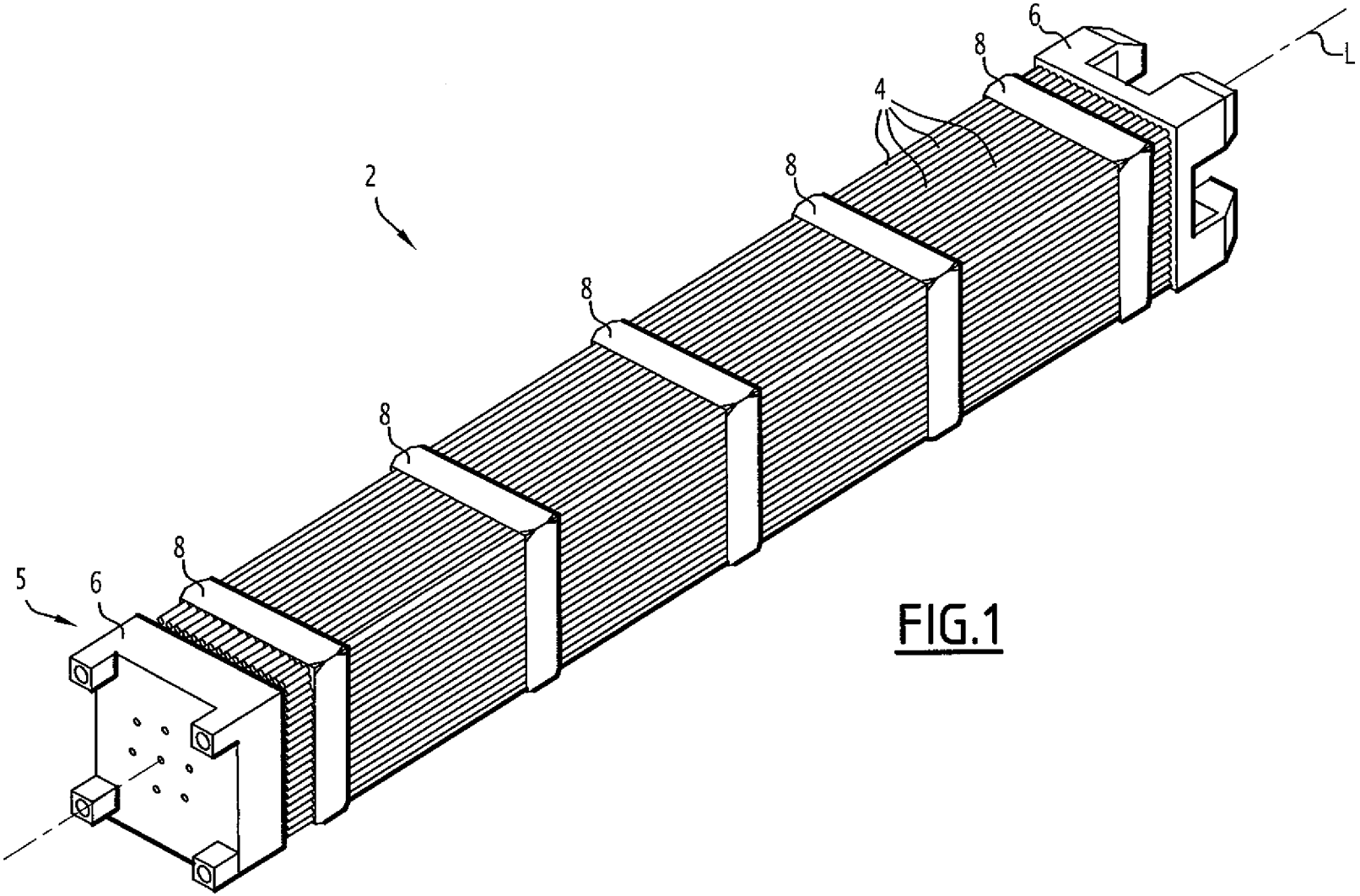
FIG. 1 is a diagrammatical perspective view of a nuclear fuel assembly.

The nuclear fuel assembly 2 of FIG. 1 is of the type designed to be used in Pressurised Water Reactors (PWR).

The assembly 2 is elongated in a longitudinal direction L. It comprises a bundle of nuclear fuel rods 4 and a frame 5 to hold the rods 4. The assembly 2 in the example illustrated has a square section.

The rods 4 are in the form of tubes filled with nuclear fuel pellets and are sealed at their ends by plugs.

The frame 5 comprises as usual two end parts 6 positioned on the longitudinal ends of the assembly 2 and guide tubes which extend longitudinally between the end parts 6 and grids 8 for holding the rods 4. The guide tubes are attached at their ends to the end parts 6. The grids 8 are attached to the guide tubes and are distributed between the end parts 6. The rods 4 pass through the grids 8 which hold them longitudinally and transversally.

Figure 2:
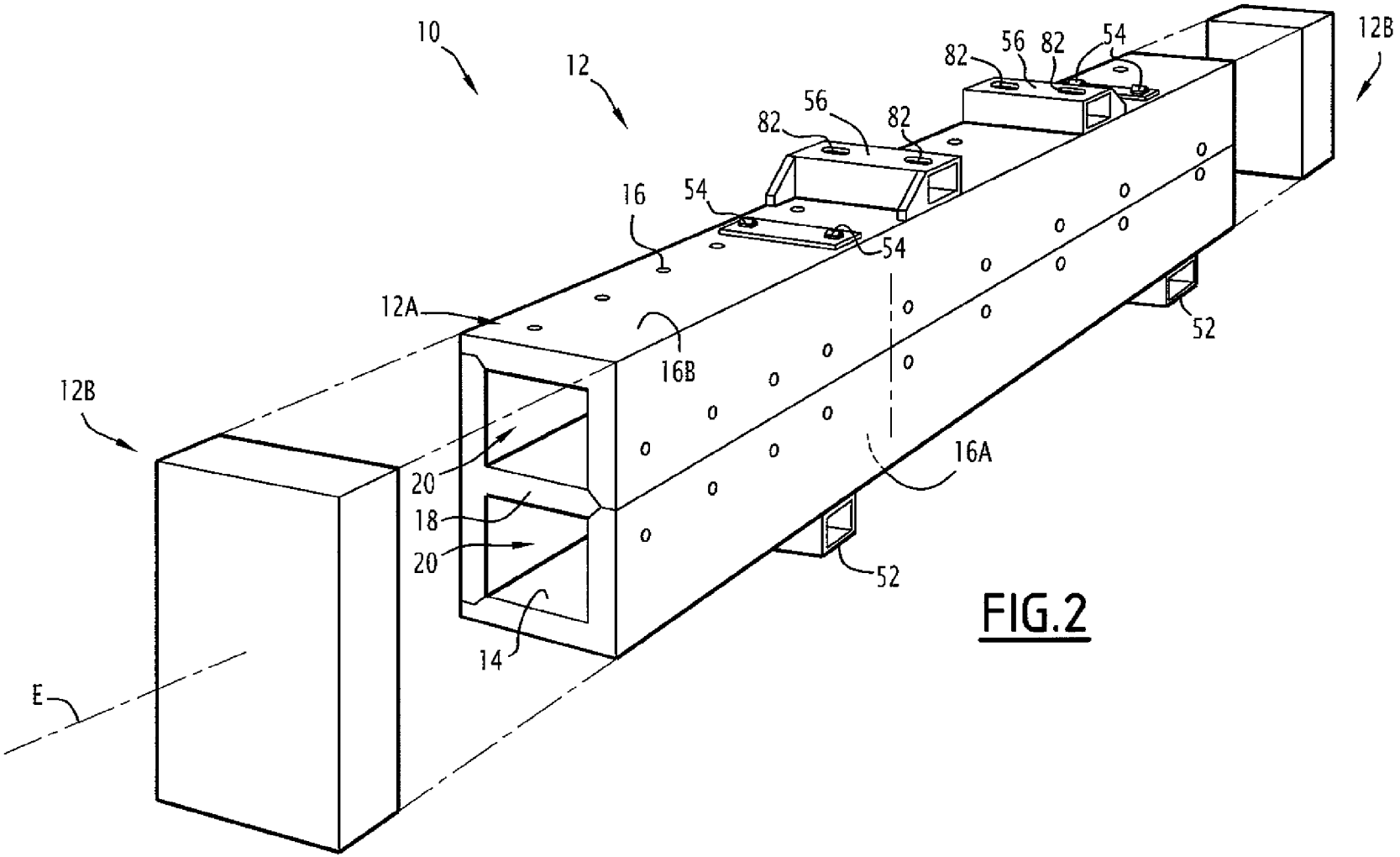
FIG. 2 is a perspective view of a container for a nuclear fuel assembly equipped with handling devices compliant with the invention.

FIG. 2 illustrates a container 10 equipped with handling devices compliant with the invention, which allow the assembly 2 to be stored and transported, for example from a production site to a nuclear power station.

The container 10 comprises a shell 12 which has a general external form that is cylindrical and elongated longitudinally in a longitudinal direction E. The shell 12 has an internal surface 14 which defines an internal cavity and an external surface 16.

The container 10 comprises a longitudinal wall 18 which separates the internal cavity from the shell 12 into two individual, distinct and separate housings 20. Each housing 20 is designed to accommodate a nuclear fuel assembly 2 such as that of FIG. 1, and has a corresponding cross section, in this case a square cross section.

The housings 20 extend in parallel on either side of the wall 18, in the longitudinal direction E of the shell 12.

The shell 12 is made of several parts. It comprises a tubular body 12A and two covers 12B to seal the longitudinal ends of the body 12A.

The body 12A of the shell 12 is formed of several parts of shell elongated in the longitudinal direction E. More precisely, the body 12A is formed by a support 36 which has a T shaped cross section, of which the base is defined by the wall 18 and two doors 34 which have an L shaped cross section, joined to form the body 12A.

In one embodiment, the doors 34 are bolted to the support 36. It is then possible to load the container 10 in the horizontal position, by removing the doors 34, by positioning the assemblies 2 onto the support 36 and then by refitting the doors 34 by bolting them back onto the support 36.

The container 10 may be stored vertically, by resting it on one of its covers 12B.

Figure 3:
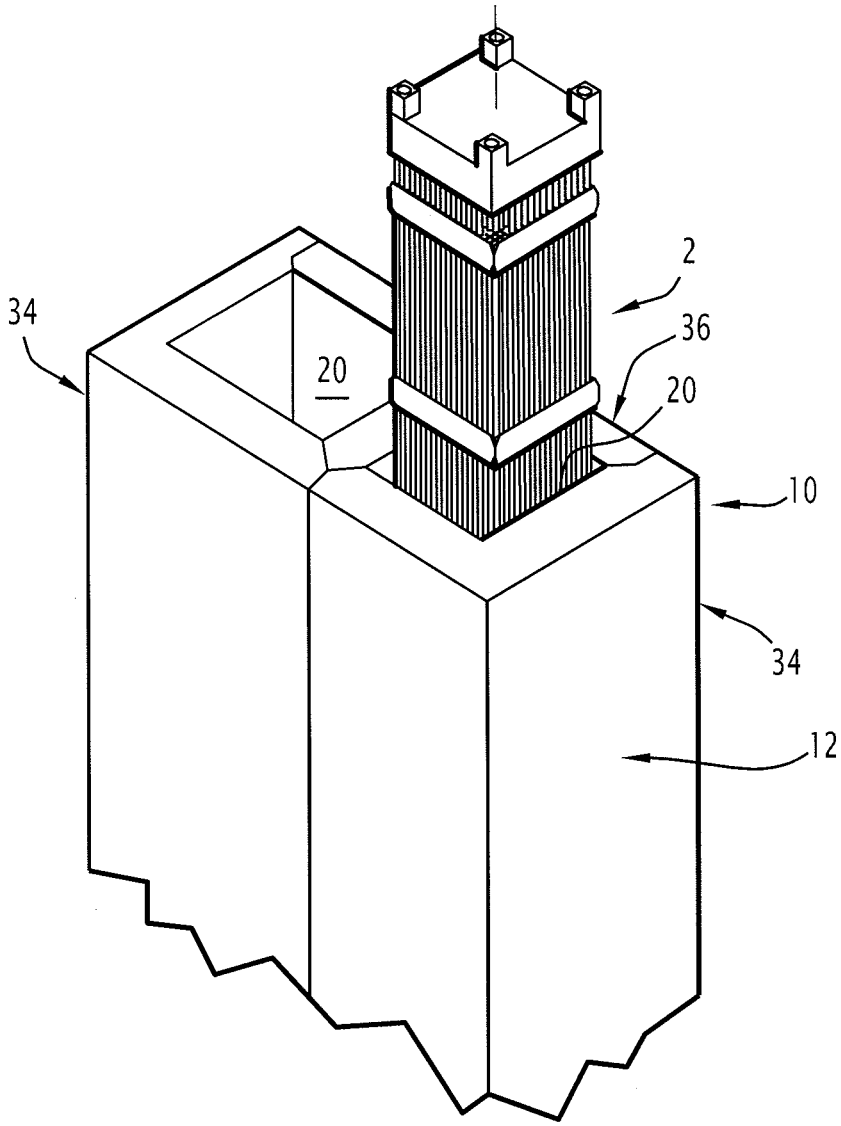
FIGS. 3 and 4 are perspective views of the container of FIG. 2, illustrating two modes of loading/unloading the container.

As shown in FIG. 3, the loading or unloading of an assembly 2 may be carried out by positioning the container 10 in the vertical position, wherein the support 36 is placed against a wall or a support structure, and the upper cover 12B is removed, the assembly 2 is gripped by its upper end part 6, in a familiar method using an appropriate lifting clamp, and the assembly 2 is moved into one of the housings 20.

This method of loading and unloading provides a major saving in space, as it avoids having to store the container 10 in the horizontal position and also a major saving of time, as it avoids having to remove the doors 34; only the upper cover 12B is to be removed.

Figure 4:
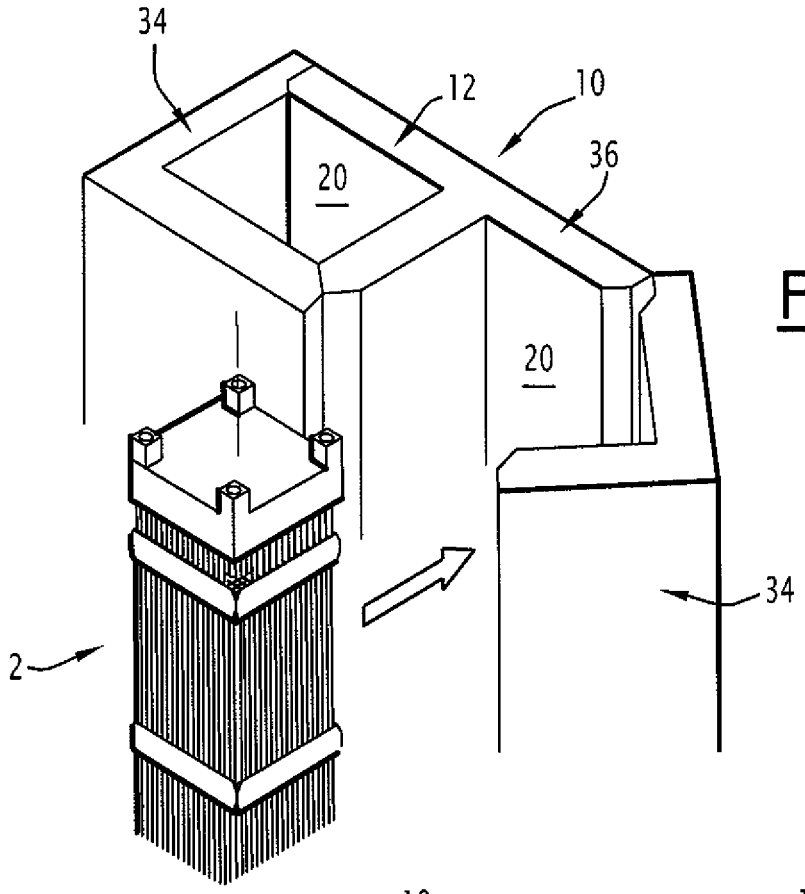

In one variant illustrated in FIG. 4, the doors 34 are articulated on the support 36 by means of hinges, around longitudinal axes.

It is then possible to load the container 10 from above, as shown in FIG. 3, or from the side as shown in FIG. 4. To do so, the container 10 is positioned in the vertical position and the upper cover 12B is removed, then the door 34 is removed from the lower cover 12B, then a door 34 is opened to insert or remove the assembly 2. This method of loading is more adapted when the height of the building is a limiting factor.

Figure 5:
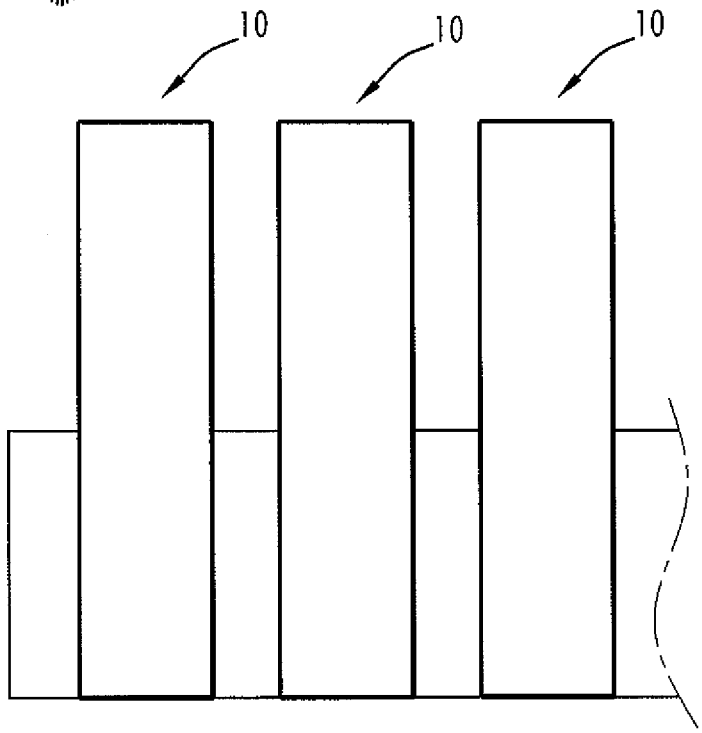
FIG. 5 is a view illustrating a device for storing containers according to FIG. 2.

As shown in FIG. 5, it is possible to provide in a nuclear power station or on a production site or temporary storage site a rack type storage device, which permits a plurality of containers 10 to be stored vertically next to one another, which provides a considerable saving of space compared to storage in the horizontal position and without being limited in time. Indeed, with a classic container which only allows storage in the horizontal position, the duration of the storage is limited to avoid damaging the fuel assembly 2, which is not designed to be stored horizontally.

As shown in FIG. 2, the container 10 comprises contact members and fastening devices for handling and transporting it.

The container 10 comprises two tubular contact feet 52 fastened transversally onto a first face 16A of the external surface 16 of the container 10. The feet 52 are designed to permit the engagement and locking of the fastening elements installed on the transport bed concerned (truck, wagon, sea or air freight container) or on the container or intermediate structure positioned below the container 10.

The container 10 comprises fastening devices_or fasteners 54 attached to a second face 16B of the external surface 16 of the container 10 opposite the first face 16A. These fastening devices 54 are designed to be attached to the feet 52 of another container 10 stacked on the container 10 or on an intermediate structure.

The container 10 comprises on the second face 16B tubes 56 adapted to accommodate the forks of a fork lift truck to permit the container 10 to be lifted and placed on a vehicle or train wagon or inversely to be unloaded. These tubes 56 are fitted to accommodate fastening devices of a handling tool and also to allow the container to be handled by suitable handling equipment (overhead crane, crane, etc.) and to be loaded/unloaded vertically to/from the transport bed.

Figures 6, 7:
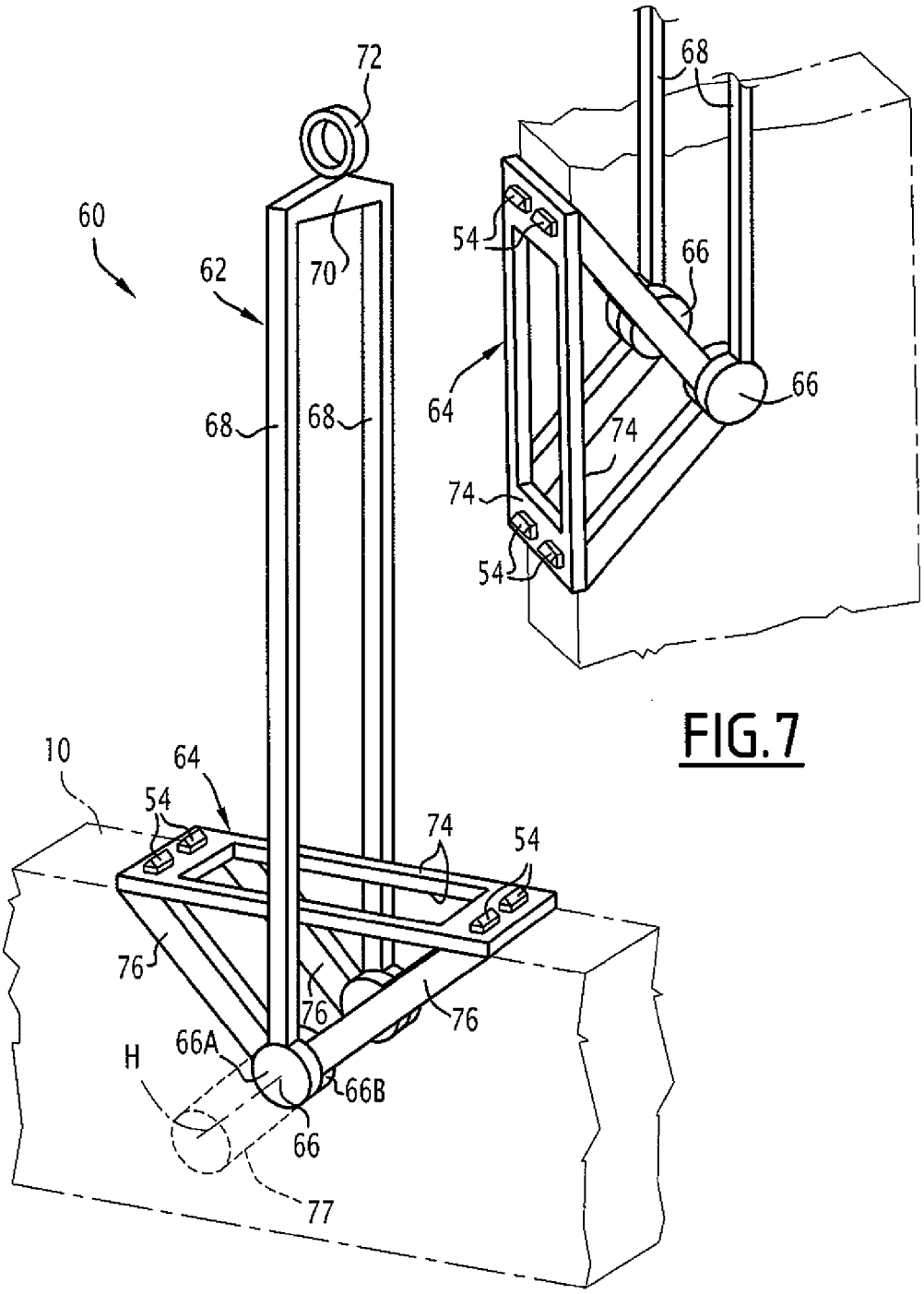
FIGS. 6 to 8 are perspective views of a lifting device compliant with the invention for F a container according to FIG. 2, illustrating different lifting and tilting configurations.
Figure 8:
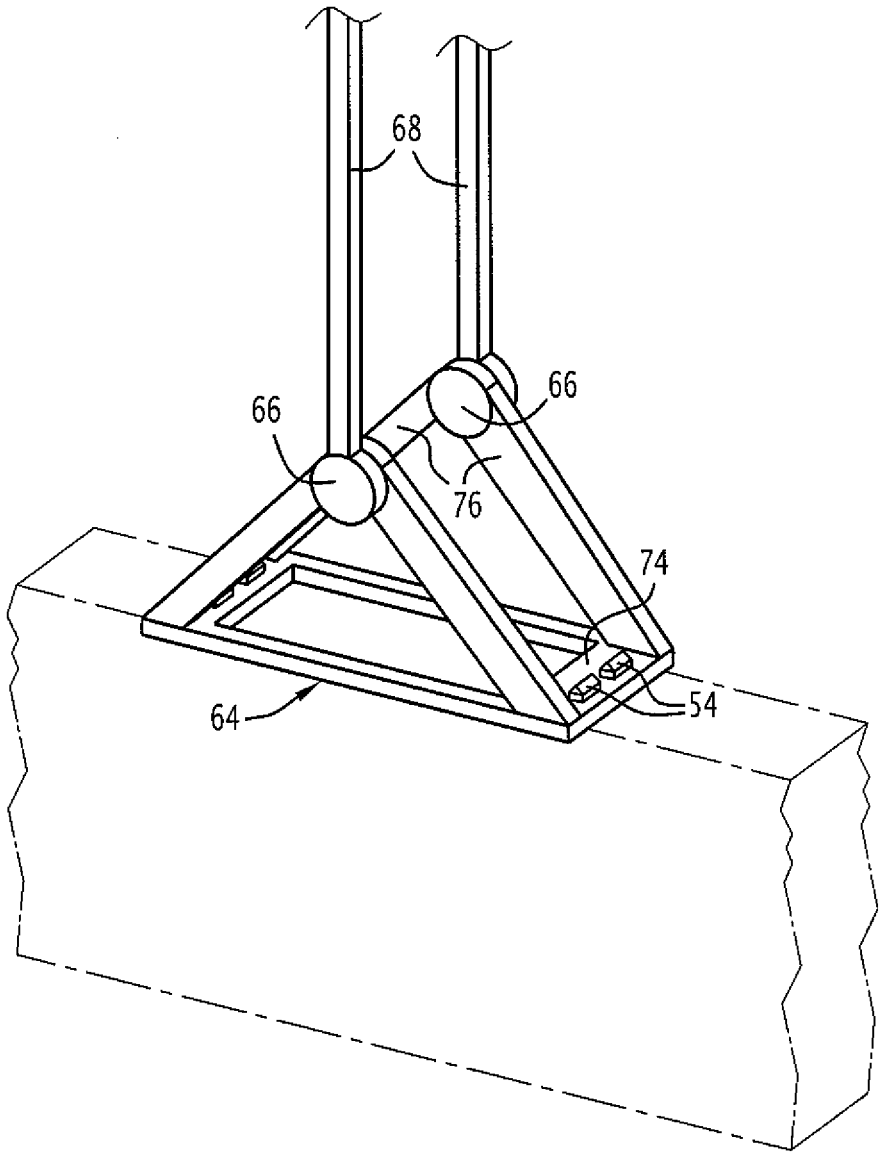

As shown in FIGS. 6 to 8, a tool 60 for lifting the handling system allows the container 10 to be handled. The lifting tool 60 is designed to be suspended for example to an overhead crane.

The lifting tool 60 comprises a stirrup shaped lifting carrier 62 and a gripping member 64 mounted so that it may rotate on the lifting carrier 62 by means of pivot type articulations 66.

The lifting carrier 62 comprises two bars 68 connected by an upper transversal bar 70 fitted with a lifting eye 72.

The articulations 66 are coaxial and are positioned at the lower ends of the bars 68 opposite the upper transversal bar 70. The articulations 66 define an axis of rotation H designed to be horizontal when the lifting tool 60 is suspended by the eye 72. The axis of rotation H extends transversally through the lower ends of the bars 68. The axis of rotation H is designed to be as close as possible to the centre of gravity of the container handled.

The gripping member or gripper 64 comprises two opposite faces 74, each bearing fastening devices 54 which allow a container 10 to be attached to the gripping member 64, as will be described in detail below.

The lifting tool 60 comprises two pairs of arms 76 connecting the gripping member 64 to the articulations 66. The two arms 76 of each pair are positioned in a V shaped layout and have their distant ends attached to the gripping member 64, and their adjacent ends joined to the corresponding articulations 66.

Each articulation 66 comprises a fixed articulation part 66A attached to a bar 68, and a mobile articulation part 66B attached to a pair of arms 76, that may rotate with respect to the fixed articulation part 66A around the axis of rotation H.

The gripping member 64 may be rotated around the axis of rotation H with respect to the lifting support 62, between 3 main positions, a first horizontal lifting position (FIG. 6) of the container 10, in which the gripping member 64 is situated between the bars 68, a second position vertical lifting position (FIG. 7) of the container 10, in which the gripping member 64 is positioned vertically and a third horizontal lifting position (FIG. 8), in which the gripping member 64 is situated below the lower ends of the bars 68. The gripping member 64 pivots at least 180° around the axis of rotation H between the two extreme horizontal lifting positions.

In each horizontal lifting position, a container 10 fastened to the gripping member 64 extends substantially horizontally (its longitudinal direction E is substantially oriented horizontally).

In the vertical lifting position, a container 10 fastened to the gripping member 64 extends substantially vertically (its longitudinal direction E is substantially oriented vertically).

The fastening devices 54 fitted on the two faces 74 permit a container 10 to be attached underneath the gripping member 64, in one or the other of the horizontal lifting positions.

The transversal distance between the bars 68 is adapted to permit a container 10 to be accommodated between the bars 68 in the first horizontal lifting position and in the vertical lifting position.

In the first horizontal lifting position and in the vertical lifting position, preferably, the axis of rotation H substantially passes through the centre of gravity of the container 10. This facilitates the passage from the first horizontal lifting position to the vertical lifting position and vice versa. The result is that the lifting tool 60 permits a container 10 to be easily moved between a horizontal position, for transport for example, and a vertical position, for the loading or unloading of the fuel assembly 2 for storage on a production site for example.

The second horizontal lifting position allows the container 10 to be gripped when there is not enough space for the bars 68 to pass on either side of the container 10, for example because it is positioned too close to another element: a wall, another container 10, etc. This permits compact storage of the containers 10, whilst still allowing them to be handled. The gripping member 64 is for example positioned in the second horizontal lifting position (FIG. 8) to grip and move the container 10 in a clear zone, then the container 10 is released and the gripping member 64 is returned to the first horizontal lifting position, to again grip the container 10 and to be able to handle it more easily, and for example place it in the vertical position.

Advantageously, the articulations 66 usually comprise means for locking the rotation of their parts 66A and 66B to block the rotation of the gripping member 64 in the various lifting positions. They may be released when they need to be rotated.

The passage from one lifting position to another is carried out for example manually. The manual passage from the first horizontal lifting position to the vertical lifting position with a container 10 is facilitated when the centre of gravity is borne by the axis of rotation, as in this case the force required to make the rotation is low.

In one variant, the lifting tool 60 comprises at least one actuator to drive in rotation the gripping member 64 with respect to the lifting carrier 62. Such a motor 77 is shown in faint in FIG. 6.

Figure 9:
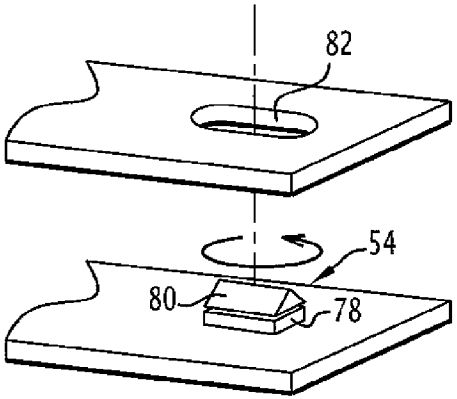
FIG. 9 is a diagrammatical perspective view of a fastening device used in the handling system.

As shown in FIG. 9, usually a fastening device 54 is of the "quarter turn" type and comprises a fixed base 78 and a pin 80 which rotates on the base 78. The pin 80 has a form that is elongated perpendicularly with respect to the axis of rotation. The fastening device 54 is designed to be inserted into an oblong orifice 82 then pivoted by 90° so that it cannot leave the orifice 82. The rotation movement of the attachments 54 of the transversal bars 94 of the container 10 or the lifting tool 60 may be generated manually or may be motorised.

Returning to FIG. 2, the feet 52 have similar orifices 82 to engage with the fastening devices 54 borne for example on the lower face 16B of the container 10 when two containers 10 are stacked. The tubes 56 also have orifices 82 to engage with the fastening devices 54 on the two faces 74 of the gripping member 64 of the lifting tool 60.

Figure 11:
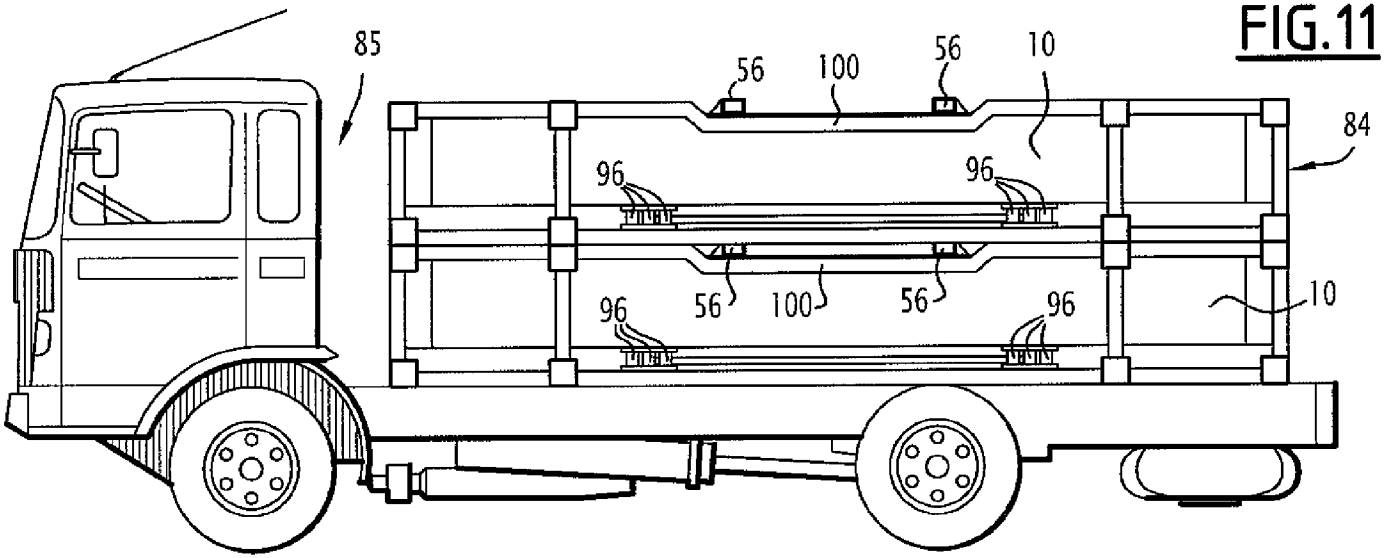
Figure 10:
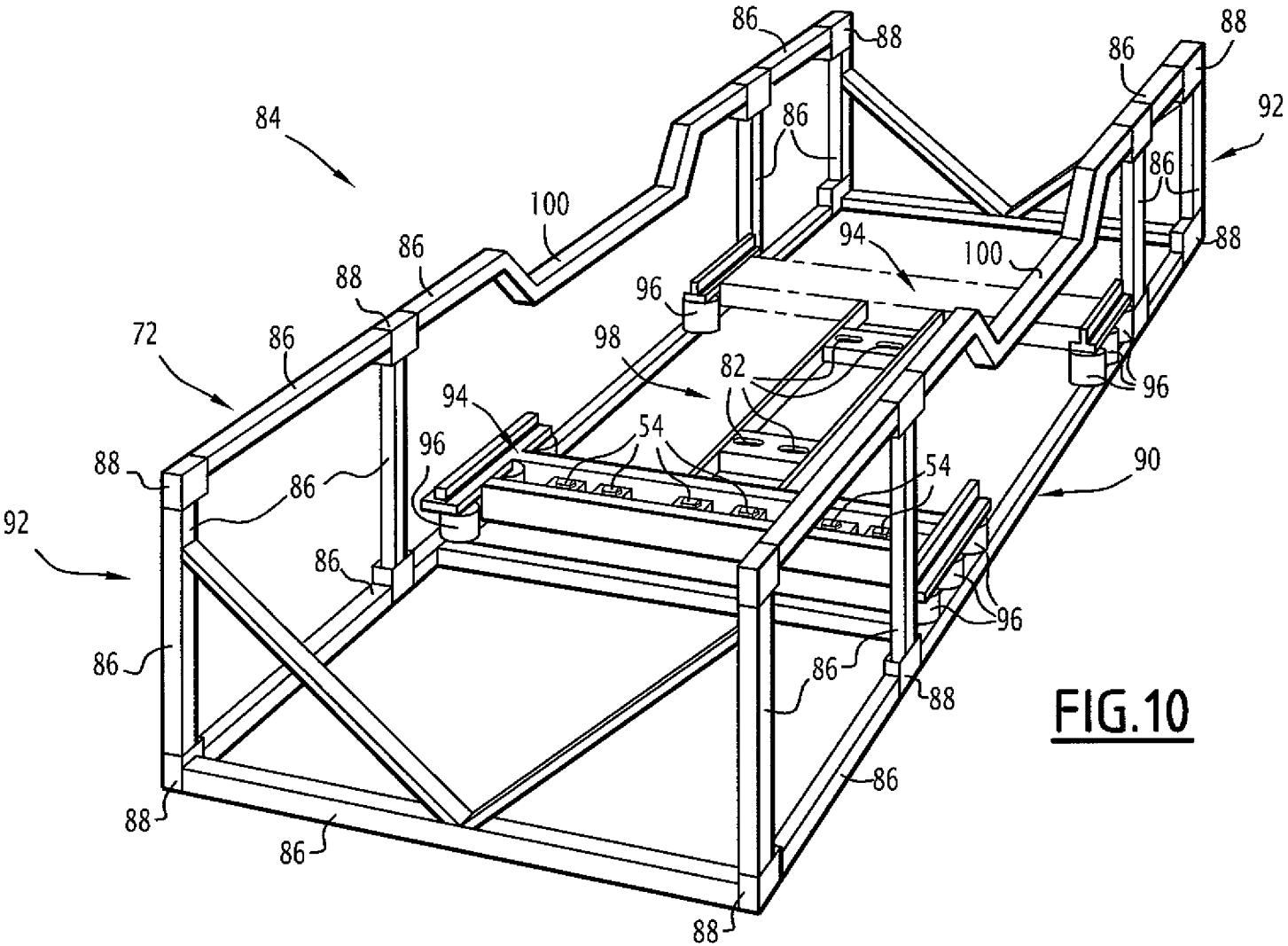
FIG. 10 is a perspective views of a chassis for transporting several containers according to FIG. 2, and FIGS. 11 and 12 are side and rear views of a vehicle transporting the chassis according to FIG. 10 and containers according to FIG. 2 positioned on the chassis.

As shown in FIG. 10, the handling system may possibly comprise a chassis 84 for the transport of one or several containers 10, for example on a road vehicle 85 (FIG. 11).

The chassis 84 is tubular, in the sense that it is formed by tubes 86 joined to one another by connectors 88.

The chassis 84 comprises a cradle 90, wherein lateral barriers 92 extend on either side of the cradle 90 and transversal support bars 94 are in contact with the cradle 90 by means of suspension and damping members 96, such as elastomer pads for example.

There are two transversal bars 94. The distance between them corresponds to that between the feet 52 (FIG. 2) of a container 10. Each transversal bar 94 carries several fastening devices 54 designed to engage with the orifices 82 of the feet 52 to attach containers 10 onto the transversal bars 94.

Figure 12:
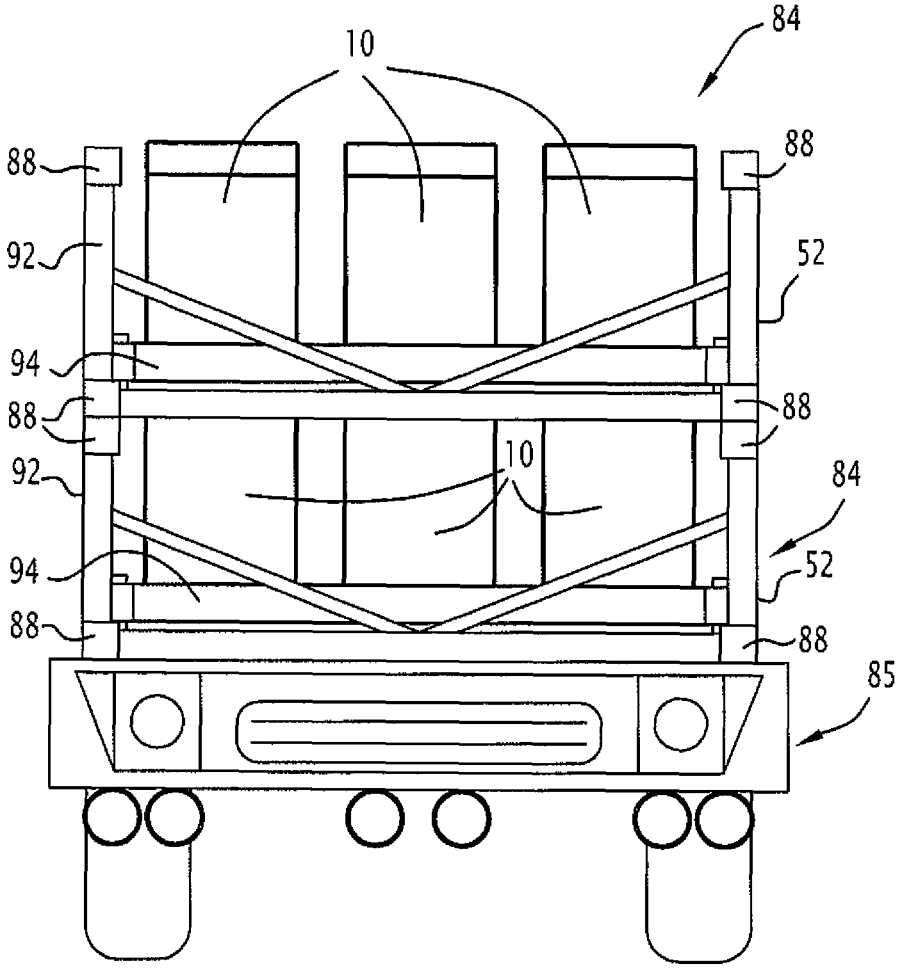

The chassis 84 comprises a lifting beam 98 which extends between the transversal bars 94 and which has orifices 82 that may engage with the fastening devices 54 of the gripping member 64 to allow either the chassis 84 to be lifted using the lifting tool 60, or to lift just the lifting beam 98/transversal bars 94 assembly after disconnecting the suspension members 96, in order to reach the containers 10 that may be placed on a second chassis 84 positioned below, as illustrated in FIGS. 11 and 12.

As shown in FIGS. 11 and 12, the chassis 84 may be placed on a loading bed of a vehicle, for example a road vehicle 85. To make it easier to fasten the chassis 84 to the vehicle 85, the connectors 88 are of the type used to manufacture maritime containers: a connector 88 has the form of a parallelepidal box, of which at least certain of its faces have attachment orifices, which allow two connectors positioned next to one another to be attached.

Once the chassis 84 has been attached to the vehicle 85, the containers 10 are loaded and attached using the fastening devices 52 and 82 of the container 10 and 54 of the chassis 84. The barriers 92 allow a second chassis 84 to be stacked on top of the first and to load and attach containers onto this second chassis. The two chassis 84 are then attached by means of their adjacent connectors 88. It may also be envisaged to load and attach the containers directly onto one another using their fastening devices 52, 54 and 82.

The use of connectors 88 of the type used to manufacture maritime containers further allows the chassis 84 loaded with its containers 10 to be handled directly. This is particularly advantageous in the case of intermodal means being used, where the loaded chassis may for example be loaded directly and fastened in a standard maritime container.

As may be seen in FIGS. 10 and 11, each barrier 92 has a setback 100 to allow the forks of a fork lift truck to pass inside the tubes 56 of a container 10, to lift the container 10 by the tubes 56 without using the lifting tool 60. The chassis according to the invention allows the container 10 to be handled with the lifting tool or with more classic handling means this providing the user with more flexibility of use and allow the tools used to be adapted according to their availability and the environment.

The handling system comprising a lifting tool 60 facilitates the handling of a container 10 equipped with handling devices 52, 54 and 56 and, in particular the passage from a container 10 from a horizontal position to a vertical position, and vice versa.

The handling is facilitated by the compactness and lightness of the container 10.

The container 10 which may be stored vertically permits compact storage without any alteration of the nuclear fuel assembly.

Transport is also facilitated. The chassis 84 is suited to accommodate several containers 10 and may engage with the lifting tool 60, which further facilitates transport and handling. The chassis 84 may be equipped with suspension members 96 which permit a new nuclear fuel assembly 2 to be preserved from vibrations during transport.

The invention was described based on a container 10 for a new nuclear fuel assembly for Pressurised Water Reactors (PWR). The invention also applies to all types of containers for new or irradiated nuclear fuel assemblies 2 for Light Water Reactors (LWR), whether for Boiling Water Reactors (BWR) or PWRs.

The invention was described based on a container 10 pre-equipped with handling devices 52, 54 and 56. It applies to all types of containers for new or irradiated nuclear fuel assemblies 2 after fitting of the handling devices 52, 54 and 56 according to the invention and the implementation of the lifting tool according to the invention, adapted to the dimensions and weight of the container concerned.

What is claimed is:

1. A handling system for a container for a nuclear fuel assembly, the handling system comprising:

a tool for lifting the container, wherein the lifting tool is configured to be suspended during lifting and comprises a lifting carrier to be suspended and a gripper for gripping the container, the gripper comprising removable fasteners for fastening the container onto the gripper, wherein the gripper is mounted to rotate on the lifting carrier about a substantially horizontal rotation axis when the lifting carrier is suspended, wherein the gripper is movable by rotation around the horizontal rotation axis with respect to the lifting carrier in a vertical lifting position permitting the container to be held by the gripper substantially vertically when the lifting carrier is suspended, the container being elongated in a longitudinal direction, the longitudinal direction being arranged vertically in the vertical lifting position, wherein the gripper is movable with respect to the lifting carrier by rotation around the horizontal rotation axis in at least one horizontal lifting position permitting the container to be held by the gripper substantially horizontally when the lifting carrier is suspended, wherein the gripper is movable with respect to the lifting carrier by rotation around the horizontal rotation axis in two horizontal lifting positions permitting the container to be held by the gripper at two different heights with respect to the lifting carrier, wherein the gripper is movable with respect to the lifting carrier by rotation around the horizontal rotation axis in the at least one horizontal lifting position, the axis of rotation extending through the container, wherein the gripper is movable with respect to the lifting carrier by rotation around the horizontal rotation axis in the at least one horizontal lifting position, the axis of rotation extending above the container.

2. The handling system according to claim 1 wherein the lifting container is stirrup-shaped and the container is positioned below a level of lower ends of bars of the stirrup-shaped lifting carrier, when in the horizontal lifting position.

3. The handling system according to claim 2 wherein the at least one horizontal lifting position includes a first horizontal lifting position and a second horizontal lifting position, the gripper pivoting 180° around the axis of rotation between the first horizontal lifting position and the second horizontal lifting position.

4. The handling system according to claim 1 wherein the lifting carrier is stirrup shaped and comprises two bars that are substantially vertical when the lifting carrier is suspended, the two bars accommodating the container between them.

5. The handling system according to claim 4 wherein the gripper is joined to each bar by two arms positioned in a V shaped layout and joined at an articulation on the bar, the two arms separating in the direction of the gripper.

6. The handling system according to claim 1 further comprising a transport chassis for several additional containers placed side by side.

7. The handling system according to claim 6 wherein the chassis comprises a cradle and transversal bars to support the containers joined to the cradle by suspensions.

8. The handling system according to claim 6 wherein the gripper and the chassis are adapted to allow the chassis to be lifted using the gripper.

9. The handling system according to claim 6 wherein the chassis comprises lateral barriers with setbacks to allow forks of a fork lift truck to pass so that the container or at least one of the additional containers may be loaded or unloaded from the chassis.

10. The handling system according to claim 6 wherein the chassis comprises chassis members joined by connectors allowing the chassis loaded with the container or at least one of the additional containers to be handled.

11. The handling system according to claim 1 wherein the horizontal axis of rotation extends close to a center of gravity of the container.

12. An assembly comprising:

the handling system as recited in claim 1; and the nuclear fuel assembly container elongated in the longitudinal direction.

13. The handling system as recited in claim 1 wherein the gripper comprises gripping elements on two opposed faces thereof allowing gripping of the container below the gripper in at least one horizontal lifting position.

14. A handling system for a container for a nuclear fuel assembly, the handling system comprising:

a tool for lifting the container, wherein the lifting tool comprises a lifting carrier to be suspended and a gripper for gripping the container, the gripper comprising removable fasteners for fastening the container onto the gripper, wherein the gripper is mounted to rotate on the lifting carrier about a substantially horizontal rotation axis when the lifting carrier is suspended, wherein the gripper is movable by rotation around the horizontal rotation axis with respect to the lifting carrier in a vertical lifting position permitting the container to be held by the gripper substantially vertically when the lifting carrier is suspended, the container being elongated in a longitudinal direction, the longitudinal direction being arranged vertically in the vertical lifting position, wherein the gripper is movable with respect to the lifting carrier by rotation around the horizontal rotation axis in at least one horizontal lifting position permitting the container to be held by the gripper substantially horizontally when the lifting carrier is suspended, wherein the gripper is movable with respect to the lifting carrier by rotation around the horizontal rotation axis in two horizontal lifting positions permitting the container to be held by the gripper at two different heights with respect to the lifting carrier.

15. The handling system according to claim 14 wherein the lifting carrier is stirrup-shaped and the container is positioned below a level of lower ends of bars of the stirrup-shaped lifting carrier, when in the horizontal lifting position.

16. The handling system according to claim 15 wherein the gripper pivots 180° around the axis of rotation between a first horizontal lifting position and a second horizontal lifting position.

17. A handling system for a container for a nuclear fuel assembly, the handling system comprising:

a tool for lifting the container, wherein the lifting tool is configured to be suspended during lifting and comprises a lifting carrier to be suspended and a gripper for gripping the container, the gripper comprising removable fasteners for fastening the container onto the gripper, wherein the gripper is mounted to rotate on the lifting carrier about a substantially horizontal rotation axis when the lifting carrier is suspended, wherein the gripper is movable by rotation around the horizontal rotation axis with respect to the lifting carrier in a vertical lifting position permitting the container to be held by the gripper substantially vertically when the lifting carrier is suspended, wherein the gripper is movable with respect to the lifting carrier by rotation around the horizontal rotation axis in at least one horizontal lifting position permitting the container to be held by the gripper substantially horizontally when the lifting carrier is suspended, wherein the gripper is movable with respect to the lifting carrier by rotation around the horizontal rotation axis in the at least one horizontal lifting position, the axis of rotation extending above the container, wherein the lifting carrier is stirrup-shaped and the entire container is positioned below a level of lower ends of bars of the stirrup-shaped lifting carrier, when in the horizontal lifting position, wherein the container is received in a vertical position between the bars of the stir-up shaped carrier.

* * * * *